US012252876B1

(12) United States Patent
Cai

(10) Patent No.: US 12,252,876 B1
(45) Date of Patent: Mar. 18, 2025

(54) FLOOR DRAIN

(71) Applicant: Taizhou Langxun Electronics Co., LTD, Taizhou (CN)

(72) Inventor: Rongwei Cai, Taizhou (CN)

(73) Assignee: Taizhou Langxun Electronics Co., LTD, Taizhou (CN)

( * ) Notice: Subject to any disclaimer, the term of this patent is extended or adjusted under 35 U.S.C. 154(b) by 0 days.

(21) Appl. No.: 18/928,938

(22) Filed: Oct. 28, 2024

(30) Foreign Application Priority Data

Jan. 17, 2024 (CN) ..... 202410072218.1
Jan. 17, 2024 (CN) ..... 202420127431.3
May 8, 2024 (CN) ..... 202420995801.5

(51) Int. Cl.
*E03F 5/04* (2006.01)

(52) U.S. Cl.
CPC ..... *E03F 5/0408* (2013.01)

(58) Field of Classification Search
CPC ..... E03F 5/0408; E03F 5/0407
USPC ..... 4/679
See application file for complete search history.

(56) References Cited

U.S. PATENT DOCUMENTS 3,529,723 A * 9/1970 Hagedorn ..... E04D 13/0409 210/163
D621,009 S * 8/2010 Mjelde ..... D23/261
8,869,319 B2 * 10/2014 Griffin ..... E04H 4/14 4/507
10,822,875 B1 * 11/2020 Hailey ..... E06C 5/32
2018/0195288 A1 * 7/2018 Huber ..... E04D 13/0409
2021/0047817 A1 * 2/2021 Berry ..... E03C 1/264
2021/0317666 A1 * 10/2021 Majocka ..... E04D 13/0409
2022/0025653 A1 * 1/2022 Huber ..... E04D 13/0409
2023/0228087 A1 * 7/2023 Majocka ..... E04D 13/0409 285/42

* cited by examiner

*Primary Examiner* — Huyen D Le
(74) *Attorney, Agent, or Firm* — Levenfeld Pearlstein, LLC

(57) ABSTRACT

A floor drain includes a floor drain edge portion, a floor drain waist, a load-bearing portion, and a counterweight element. The floor drain edge portion has an outer edge and a circular inner edge. The floor drain waist is formed by extending inward and upward from the circular inner edge, and a distal end of the floor drain waist forms a waist edge. The load-bearing portion is connected to the waist edge. The counterweight element is disposed on the load-bearing portion. The floor drain waist extends upward to form a water leakage space. The water leakage space is located below the counterweight element. Water leakage holes are formed in the floor drain waist, and the water leakage holes are configured to allow water to enter the water leakage space through the water leakage holes. The floor drain of the present disclosure has a relatively fast drainage speed, and is not easily displaced relative to the floor when disposed above a drainage hole of a shower room.

30 Claims, 17 Drawing Sheets

FLOOR DRAIN

TECHNICAL FIELD

The present disclosure relates to the field of floor drains.

BACKGROUND

Existing shower rooms are provided with drainage holes, so that water in the shower rooms may be drained through the drainage holes. A floor drain covers the drainage hole, thereby preventing foreign objects (e.g., rings, and hair) from entering the drainage hole.

SUMMARY OF THE DISCLOSURE

Exemplary embodiments of the present disclosure may solve at least some of the above problems. The present disclosure provides a floor drain. The floor drain includes a floor drain edge portion, a floor drain waist, a load-bearing portion, and a counterweight element. The floor drain edge portion has an outer edge and a circular inner edge. The floor drain waist is formed by extending inward and upward from the circular inner edge, and a distal end of the floor drain waist forms a waist edge. The load-bearing portion is connected to the waist edge. The counterweight element is disposed on the load-bearing portion. The floor drain waist extends upward to form a water leakage space. The water leakage space is located below the counterweight element. Water leakage holes are formed in the floor drain waist, and the water leakage holes are configured to allow water to enter the water leakage space through the water leakage holes.

According to the above floor drain, the floor drain waist is formed by extending inward from the circular inner edge and obliquely upward, and the floor drain waist extends obliquely upward to form an upward narrowed water leakage space.

According to the above floor drain, the floor drain waist extends inward from the circular inner edge in the shape of a dome, and the floor drain waist forms the upward narrowed water leakage space in the shape of a dome.

According to the above floor drain, cross-sections of the load-bearing portion and the counterweight element are circular.

According to the above floor drain, an angle $\varphi$ between the floor drain waist and a horizontal plane is in a value range of: $12° \leq \varphi \leq 20°$.

According to the above floor drain, a height H of the water leakage space is in a value range of: 0.07874 inches (2 mm)$\leq$H$\leq$0.35433 inches (9 mm).

According to the above floor drain, a cross section of the floor drain waist is arc-shaped, and a radius R of the arc is in a value range of: 2.3622 inches (60 mm)$\leq$R$\leq$3.5433 inches (90 mm).

According to the above floor drain, a center of the arc is below the floor drain, such that the floor drain waist is protruded away from the floor drain edge portion.

According to the above floor drain, a center of the arc is above the floor drain, such that the floor drain waist is protruded toward the floor drain edge portion.

According to the above floor drain, the floor drain further includes a load-bearing reinforcement portion, which is disposed on the floor drain waist and the floor drain edge portion and below the floor drain waist.

According to the above floor drain, the load-bearing reinforcement portion includes at least two reinforcement ribs, and the reinforcement ribs are formed by extending in a radial direction of the floor drain.

According to the above floor drain, the water leakage holes include at least one first waist through hole passing through the floor drain waist in a vertical direction.

According to the above floor drain, the water leakage holes further include at least one second waist through hole passing through the floor drain waist in the vertical direction. A cross-sectional area of the first waist through hole is different from that of the second waist through hole.

According to the above floor drain, a groove is disposed on the floor drain waist, and the groove is formed by recessing from the upper surface of the floor drain waist and surrounding the load-bearing portion.

According to the above floor drain, at least one groove through hole is formed in the floor drain waist, and the groove through hole extends downward from a bottom of the groove and passes through the floor drain waist.

According to the above floor drain, the floor drain further includes a blocking portion, which is disposed on the floor drain edge portion and the floor drain waist and above the floor drain edge portion and the floor drain waist.

According to the above floor drain, the blocking portion includes at least two blocking ribs formed by extending in a radial direction of the floor drain.

According to the above floor drain, the floor drain edge portion, the floor drain waist and the load-bearing portion are formed by means of integral molding.

According to the above floor drain, the floor drain edge portion, the floor drain waist and the load-bearing portion are made of rubber.

According to the above floor drain, the floor drain is configured to cover a drainage hole of a shower room. The counterweight element is substantially located in the middle of the drainage hole of the shower room.

According to the above floor drain, the drainage hole is substantially located in the middle of the floor of the shower room, and the floor of the shower room is inclined toward the drainage hole.

According to the above floor drain, a density of the counterweight element is greater than that of each of the floor drain edge portion, the floor drain waist and the load-bearing portion, such that the counterweight element applies gravity to the floor drain edge portion such that the floor drain edge portion is attached to or around the drainage hole.

According to the above floor drain, a faucet is installed at an upper portion of a side of the shower room, and the faucet and the drainage hole are staggered from each other.

According to the above floor drain, a weight G of the counterweight element is in a value range of: 50 g<G<100 g.

According to the above floor drain, a radius A of the outer edge of the floor drain edge portion is in a value range of: 2.165 inches (55 mm)<A<3.937 inches (100 mm).

According to the above floor drain, a radius B of the inner edge of the floor drain edge portion is in a value range of: 1.88976 inches (48 mm)$\leq$B$\leq$ 3.34646 inches (85 mm).

According to the above floor drain, a total height K of the floor drain is in a value range of: 0.5905 inches (15 mm)$\leq$K$\leq$0.787 inches (20 mm).

According to the above floor drain, a height h of the counterweight element is in a value range of: 0.197 inches (5 mm)$\leq$h$\leq$0.276 inches (7 mm).

According to the above floor drain, a thickness T of the floor drain waist is in a value range of: 0.0906 inches (2.3 mm)$\leq$T$\leq$0.102 inches (2.6 mm).

According to the above floor drain, a total height K of the floor drain is 0.669 inches (17 mm), and a weight G of the counterweight element 302 is 90 g; a thickness T of the floor drain waist 104 is 0.09449 inches (2.4 mm); a height h of the counterweight element 302 is 0.23622 inches (6 mm); an angle φ between the floor drain waist 104 and a horizontal plane is 20°; a radius R of an arc of the floor drain waist 104 is 3.1496 inches (80 mm); a radius B of the inner edge of the floor drain edge portion 102 is 2.48 inches (63 mm); and a radius A of the outer edge 112 of the floor drain edge portion 102 is 2.7559 inches (70 mm).

The floor drain of the present disclosure has a relatively high drainage speed, and is not easily displaced relative to the floor when disposed above a drainage hole of a shower room.

BRIEF DESCRIPTION OF THE DRAWINGS

The features and advantages of the present disclosure can be better understood by reading the following detailed description with reference to accompanying drawings. In all the accompanying drawings, the same reference numeral represents the same component. In the accompanying drawings.

DETAILED DESCRIPTION OF EMBODIMENTS

Figure 1A:
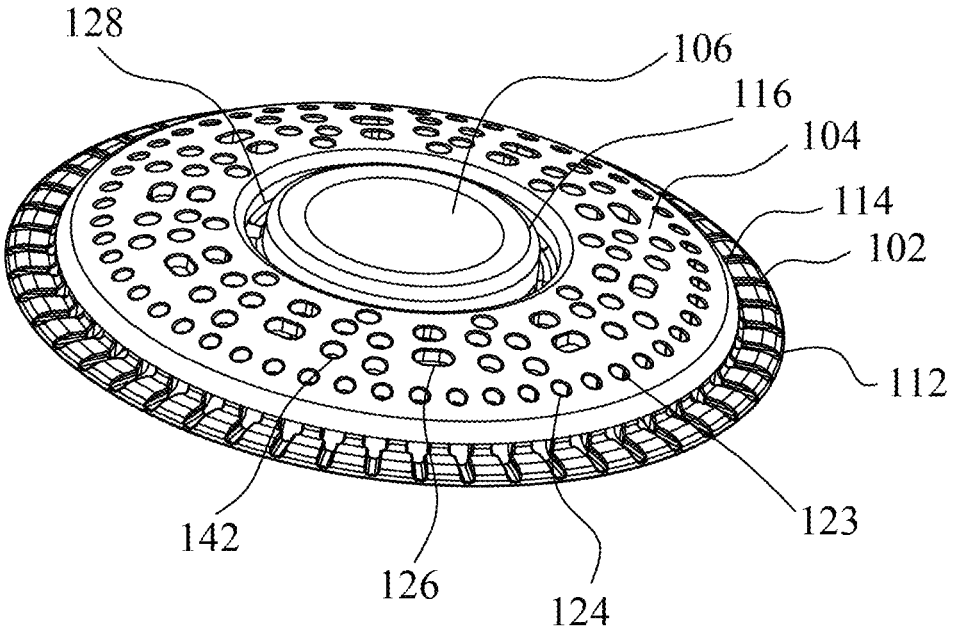
FIG. 1A is a perspective view of a first embodiment of a floor drain according to the present disclosure when viewed from top to bottom.

Various specific embodiments of the present disclosure are described below with reference to the drawings which constitute part of this specification. It should be understood that, in the following accompanying drawings, the same reference numeral is used for the same component. It should be understood that although the terms indicating directions, such as "upper", "lower", "left", "right", "inner", "outer", and so on are used in the present disclosure to describe structural parts and elements in various examples of the present disclosure, these terms are used herein only for ease of description and are determined based on the exemplary orientations as shown in the accompanying drawings. Since the arrangements in the embodiments disclosed in the present disclosure may be in various directions, these terms indicating directions are only illustrative and should not be considered as limitations.

FIG. 1A is a perspective view of a first embodiment of a floor drain according to the present disclosure when viewed from top to bottom, which shows an external structure of the floor drain 100. As shown in FIG. 1A, the floor drain includes a floor drain edge portion 102, a floor drain waist 104, and a load-bearing portion 106. The floor drain waist 104 is arranged between the floor drain edge portion 102 and the load-bearing portion 106, and connected the floor drain edge portion 102 to the load-bearing portion 106.

Specifically, as shown in FIG. 1A, the floor drain edge portion 102 is substantially annular. The floor drain edge portion 102 has an outer edge 112 and a circular inner edge 114. The floor drain waist 104 is substantially in the shape of an umbrella. The floor drain waist 104 is formed by extending inward and upward from the circular inner edge 114, and a distal end of the floor drain waist 104 forms a waist edge 116. The load-bearing portion 106 is substantially disc-shaped. The load-bearing portion 106 is connected to the waist edge 116. The load-bearing portion 106 is arranged at the top of the floor drain. The load-bearing portion 106 is configured to engage around a counterweight element 302 (see FIGS. 3 and 6). The floor drain waist 104 extends upward to form a water leakage space 212 (see FIGS. 2 and 6).

As shown in FIG. 1A, water leakage holes 123 are provided on the floor drain waist 104. The water leakage holes 123 are configured to allow water to enter the water leakage space 212 through the water leakage holes 123. The water leakage holes 123 include a plurality of first waist through holes 124 and a plurality of second waist through holes 126. The first waist through hole 124 and the second waist through hole 126 pass through the floor drain waist 104 in a vertical direction. In other words, an extension direction of each of the first waist through hole 124 and the second waist through hole 126 is approximately 90° to a lower surface of the floor drain edge portion 102. The cross-sectional area of the first waist through hole 124 is different from that of the second waist through hole 126. In the first embodiment of the floor drain according to the present disclosure, the cross-sectional area of the first waist through hole 124 is smaller than that of the second waist through hole 126. As shown in FIG. 1A, a part of the plurality of first waist through holes 124 are disposed close to the floor drain edge portion 102 and are evenly arranged along a circumferential direction of the floor drain. The other part of the plurality of first waist through holes 124 is arranged into a plurality of groups 142. Each group 142 includes five first waist through holes 124. The plurality of groups 142 are evenly arranged along the circumferential direction of the floor drain. The second waist through holes 126 are arranged between two adjacent groups 142. The plurality of first waist through holes 124 and the plurality of second waist through holes 126 enable the water outside the floor drain to flow downward into the water leakage space 212 along the direction of gravity thereof, so as to be drained as soon as possible.

It should be noted that, although the first embodiment of the floor drain according to the present disclosure shows that the water leakage holes 123 include a plurality of first waist through holes 124 and a plurality of second waist through holes 126, those skilled in the art may understand that in other embodiments, the water leakage holes 123 do not necessarily include the second waist through holes 126. Those skilled in the art may also understand that at least one first waist through hole 124 and at least one second waist through hole 126 both fall within the scope of protection of the present disclosure.

In addition, as shown in FIG. 1A, a groove 128 is further disposed on the floor drain waist 104. The groove is formed by recessing downward from the upper surface of the floor drain waist 104 and surrounding the load-bearing portion 106.

Figure 1B:
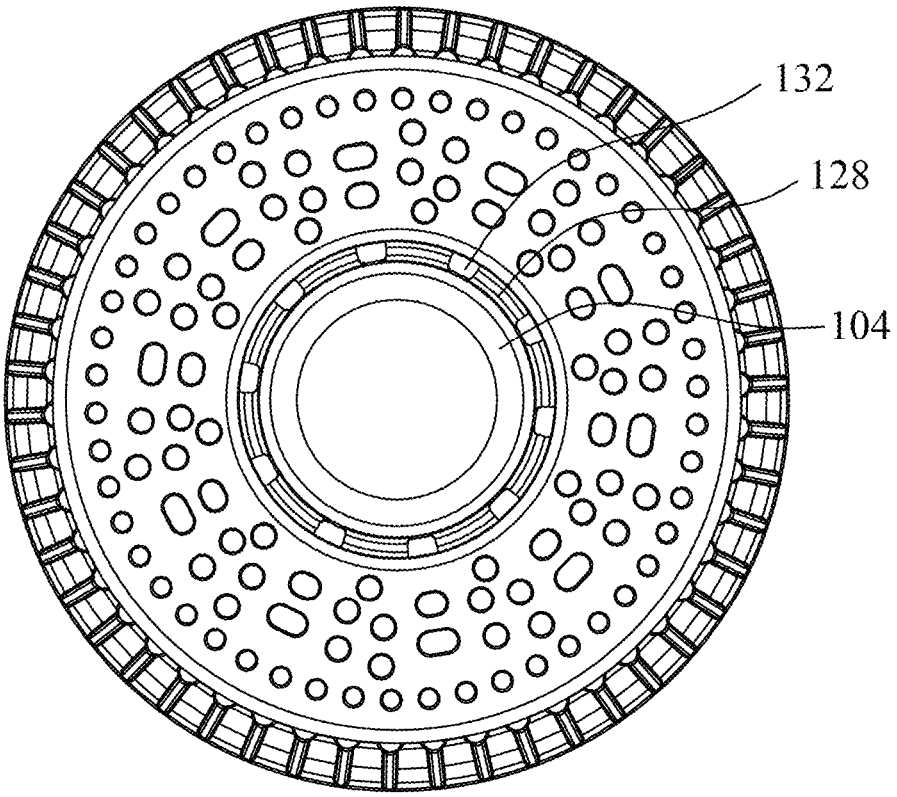
FIG. 1B is a top view of the first embodiment of the floor drain according to the present disclosure as shown in FIG. 1A.

FIG. 1B is a top view of the first embodiment of the floor drain according to the present disclosure as shown in FIG. 1A, which better shows groove through holes 132 of the groove 128 in FIG. 1A. As shown in FIG. 1B, a plurality of groove through holes 132 are further formed in the floor drain waist 104. The groove through hole 132 extends downward from a bottom (i.e., the lower surface) of the groove 128 and passes through the floor drain waist 104.

It should be noted that, although a plurality of groove through holes 132 are shown in the present disclosure, at least one groove through hole 132 also falls within the scope of protection of the present disclosure.

Figure 2:
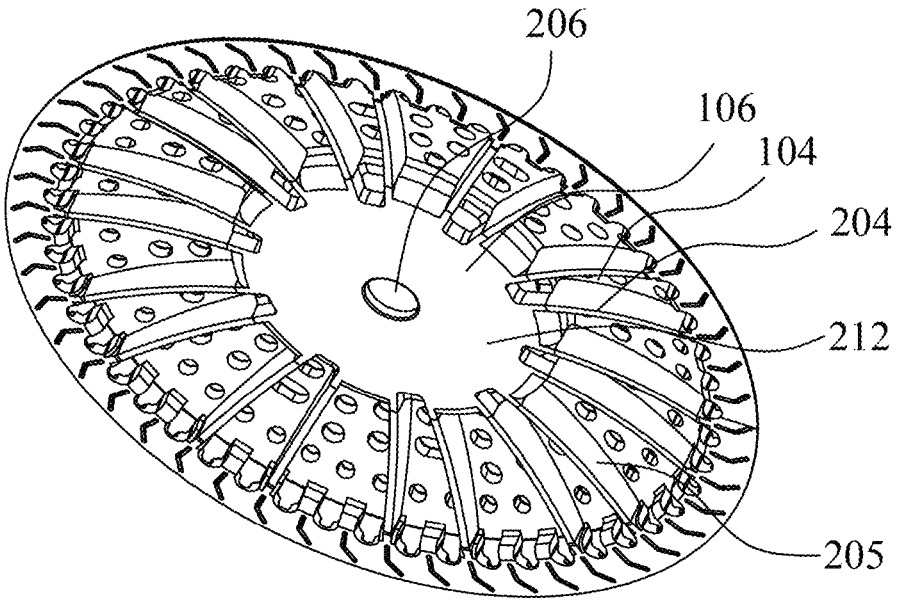
FIG. 2 is a perspective view of the first embodiment of the floor drain according to the present disclosure as shown in FIG. 1A when viewed from bottom to top.

FIG. 2 is a perspective view of the first embodiment of the floor drain according to the present disclosure as shown in FIG. 1A when viewed from bottom to top, which shows an internal structure of the floor drain 100. As shown in FIG. 2, the floor drain further includes a load-bearing reinforcement portion 204. The load-bearing reinforcement portion 204 is disposed on the floor drain waist 104 and the floor drain edge portion 102 and below the floor drain waist 104. The load-bearing reinforcement portion 204 is configured to improve the connection strength between the floor drain waist 104 and the floor drain edge portion 102, contributing to the maintenance of the water leakage space 212.

As shown in FIG. 2, the load-bearing reinforcement portion 204 includes a plurality of reinforcement ribs 205. Each of the plurality of reinforcement ribs 205 is formed by extending along the radial direction of the floor drain, thereby connecting the floor drain waist 104 and the floor drain edge portion 102. The reinforcement ribs 205 are evenly arranged along the circumferential direction of the floor drain. In the first embodiment of the floor drain according to the present disclosure, the plurality of reinforcement ribs 205 are offset from the first waist through holes 124 and the second waist through holes 126. In other words, in the vertical direction, arranging the plurality of reinforcement ribs 205 will not reduce the cross-sectional areas of the first waist through holes 124 and the second waist through holes 126, thereby not hindering the flow of water into the water leakage space 212.

Figure 3:
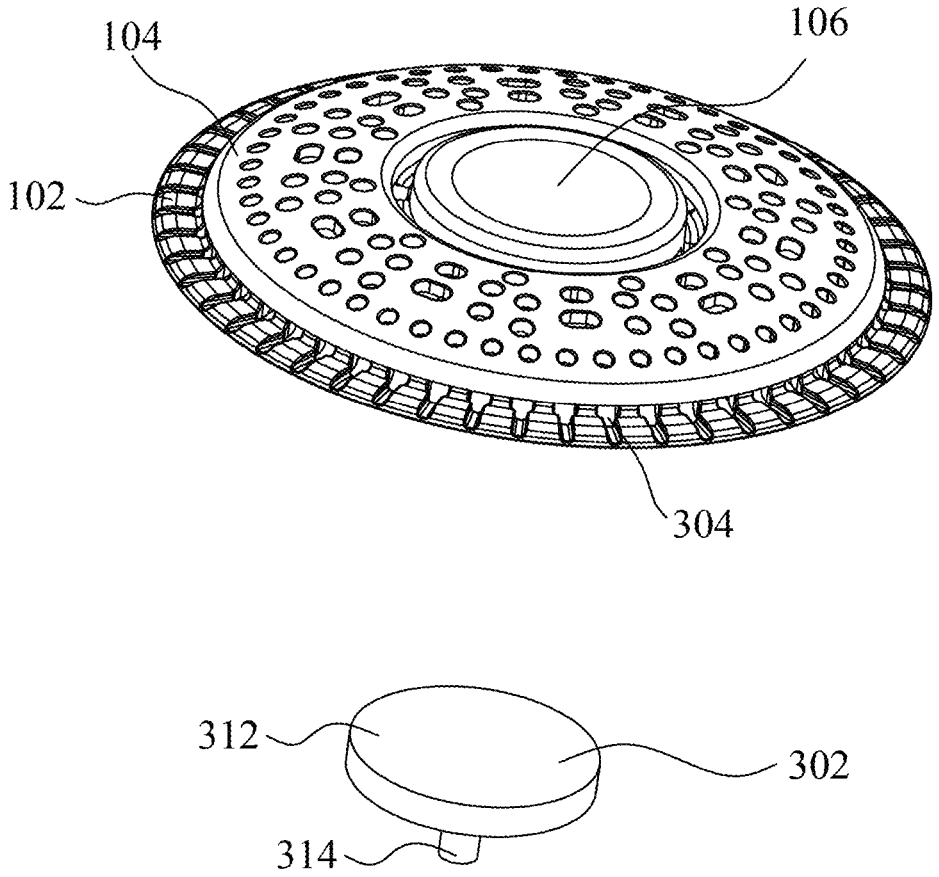
FIG. 3 is an exploded view of the first embodiment of the floor drain according to the present disclosure as shown in FIG. 1A.

In addition, as shown in FIG. 2, a cavity 206 is formed in a lower surface of the load-bearing portion 106 for engaging with the counterweight element 302 (see FIG. 3).

FIG. 3 is an exploded view of the first embodiment of the floor drain according to the present disclosure as shown in FIG. 1A, which shows the installation relationship and the specific structure of the counterweight element 302 in the floor drain 100. As shown in FIG. 3, the floor drain further includes the counterweight element 302. The counterweight element 302 is disposed on the load-bearing portion 106 and above the water leakage space 212. In the first embodiment of the floor drain according to the present disclosure, the load-bearing portion 106 engages around the counterweight element 302. Specifically, the cross-section of the counterweight element 302 is circular. The counterweight element 302 includes a substantially disc-shaped counterweight body 312 and a positioning rod 314. The positioning rod 314 is disposed below and connected to the counterweight body 312. The cross-section of the load-bearing portion 106 is circular. The counterweight body 312, the positioning rod 314 and the load-bearing portion 106 are coaxially arranged. The positioning rod 314 can extend into the cavity 206 on the lower surface of the load-bearing portion 106 (see FIG. 2), enabling the load-bearing portion 106 and the counterweight element 302 to be positioned relative to each other. It may be understood that in other embodiments, the counterweight element 302 does not necessarily include the positioning rod 314. The density of the counterweight element 302 is greater than that of each of the floor drain edge portion 102, the floor drain waist 104, and the load-bearing portion 106, so that the counterweight element 302 can apply gravity to the floor drain edge portion 102. The weight G of the counterweight element 302 is in a value range of: $50\ g<G<100\ g$. When the floor drain is disposed on the floor 722 (see FIG. 7A), the weight of the counterweight element 302 may effectively keep the floor drain in place (i.e., being stationary relative to the floor 722). In the present disclosure, the floor drain edge portion 102, the floor drain waist 104 and the load-bearing portion 106 of the floor drain are formed by means of integral molding. The floor drain edge portion 102, the floor drain waist 104 and the load-bearing portion 106 of the floor drain may be molded on the counterweight element 302 by means of secondary injection molding. According to an embodiment, the floor drain edge portion 102, the floor drain waist 104 and the load-bearing portion 106 are made of flexible materials. The counterweight element 302 may be made of metal or an alloy.

As shown in FIG. 3, a plurality of edge portion through holes 304 are formed in the floor drain edge portion 102. The plurality of edge portion through holes 304 are evenly arranged along the circumferential direction of the floor drain. The edge portion through hole 304 extends along the radial direction of the floor drain and passes through the floor drain edge portion 102 approximately in the horizontal direction, so that water can enter the water leakage space 212 through the edge portion through hole 304 approximately in the horizontal direction.

Figure 4:
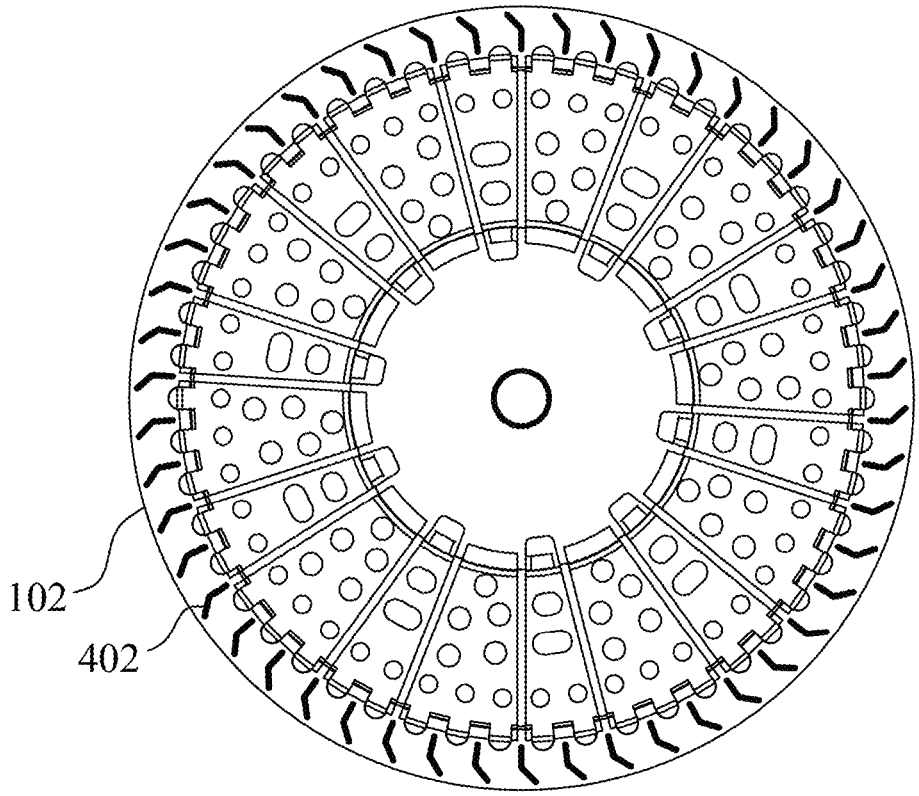
FIG. 4 is a bottom view of the first embodiment of the floor drain according to the present disclosure as shown in FIG. 1A.

FIG. 4 is a bottom view of the first embodiment of the floor drain according to the present disclosure as shown in FIG. 1A, which shows a suction groove 402 on the outer edge 102 in FIG. 1.

As shown in FIG. 4, a plurality of suction grooves 402 are disposed on the floor drain edge portion 102. The plurality of suction grooves 402 are evenly arranged along the circumferential direction of the floor drain. The suction groove 402 is formed by recessing upward from the lower surface of the floor drain edge portion 102.

Figure 5:
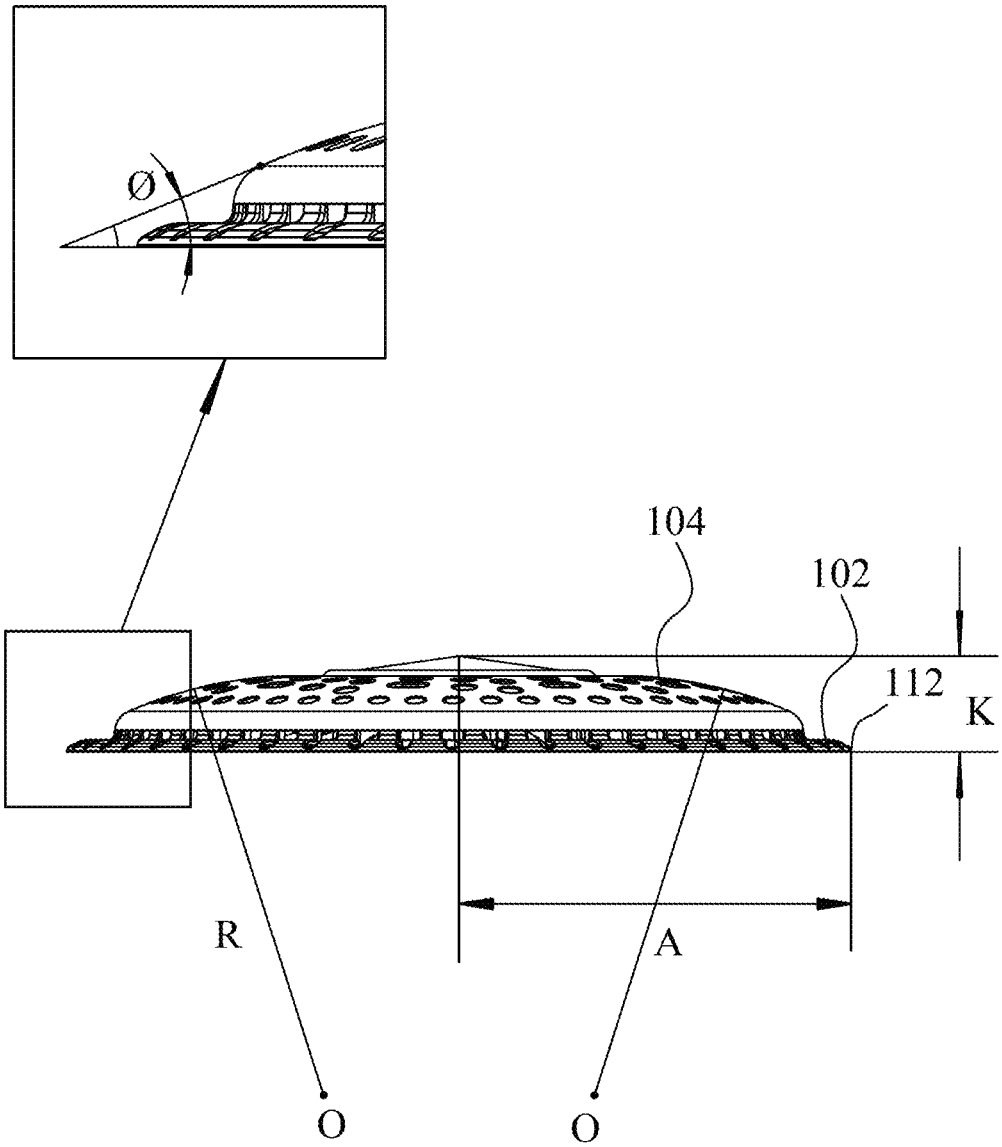
FIG. 5 is a front view of the first embodiment of the floor drain according t4 the present disclosure as shown in FIG. 1A.

FIG. 5 is a front view of the first embodiment of the floor drain of the present disclosure as shown in FIG. 1A, which shows specific structures and specific dimensions of the floor drain edge portion 102 and the floor drain waist 104.

As shown in FIG. 5, a radius A of the outer edge 112 of the floor drain edge portion 102 is in a value range of: 2.165 inches (55 mm)<A<3.937 inches (100 mm). The floor drain waist 104 is formed by extending inward and obliquely upward from the circular inner edge 114 of the floor drain edge portion 102. The floor drain waist 104 extends obliquely upward to form the upward narrowed water leakage space 212 (see FIG. 2). Upward narrowed means that the floor drain waist 104 is inclined, so that the water leakage space 212 is narrowed upward and substantially flared. In other words, the inner edge of the floor drain waist 104 serves as an outer edge of the water leakage space 212, so that when the floor drain waist 104 is inclined, the outer edge of the water leakage space 212 gradually narrows upward. More specifically, in this embodiment, the floor drain waist 104 is formed by extending inward from the circular inner edge 114 of the floor drain edge portion 102 and in the shape of a dome, and the floor drain waist 104 forms the upward narrowed water leakage space 212 in the shape of a dome. The cross-section of the floor drain waist 104 is an arc, which has a center O. The center O is below the floor drain, so that the floor drain waist 104 is protruded away from the floor drain edge portion 102. A radius R of the arc is in a value range of: 2.3622 inches (60 mm)≤R≤3.5432 inches (90 mm). An angle φ between the floor drain waist 104 and the horizontal plane is in a value range of: 12°≤φ≤20°. More specifically, the angle φ between each point on the floor drain waist 104 and the horizontal plane (i.e., the lower surface of the floor drain edge portion 102) is in the value range of: 12°≤φ≤20°. A total height K of the floor drain is in a value range of: 0.59055 inches (15 mm)≤K≤0.7874 inches (20 mm). The angle φ and the total height K of the floor drain enable the floor drain waist 104 to have a slope, the floor drain to have a low total height when the floor drain is installed on the floor 722 (see FIG. 7A), and the weight of the counterweight element 302 is relative high. In this way, on one hand, the water leakage space 212 is ensured, on the other hand, people are prevented from kicking the floor drain.

Figure 6:
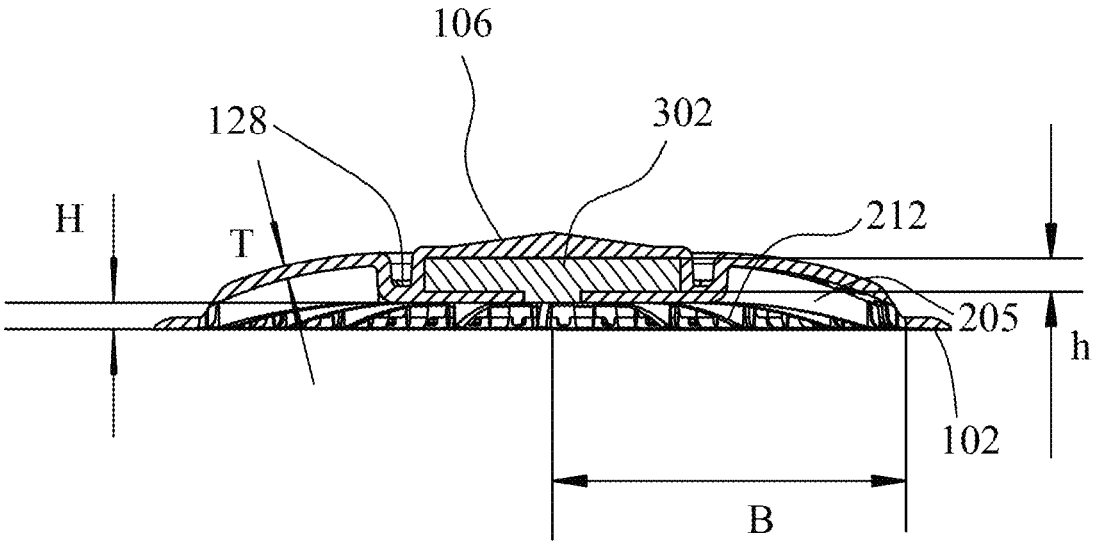
FIG. 6 is a sectional view of the first embodiment of the floor drain according to the present disclosure as shown in FIG. 1A.

FIG. 6 is a sectional view of the first embodiment of the floor drain according to the present disclosure as shown in FIG. 1A, which shows specific structures of the load-bearing portion 106, the floor drain edge portion 102, and the floor drain waist 104.

As shown in FIG. 6, a top surface of the load-bearing portion 106 is a cone protruding upward. When water drops onto the top surface of the load-bearing portion 106, the water is guided downward by the cone surface and slides outward and drops into the groove 128, and then enters the water leakage space 212 through the groove through holes 132 (see FIG. 1B). A height H of the water leakage space 212 is in a value range of: 0.07874 inches (2 mm)≤H≤0.3543 inches (9 mm). A height h of the counterweight element 302 is in a value range of: 0.1969 inches (5 mm)≤h≤0.27559 inches (7 mm). It should be noted that the "height h of the counterweight element 302" in the present disclosure refers to the "height h of the counterweight body 312". A thickness T of the floor drain waist 104 is in a value range of: 0.09055 inches (2.3 mm)≤T≤0.10236 inches (2.6 mm). In addition, a radius B of the inner edge (e.g., the circular inner edge 114, see FIG. 1A) of the floor drain edge portion 102 is in a value range of: 1.88976 inches (48 mm)≤B≤3.34646 inches (85 mm).

Figure 7A:
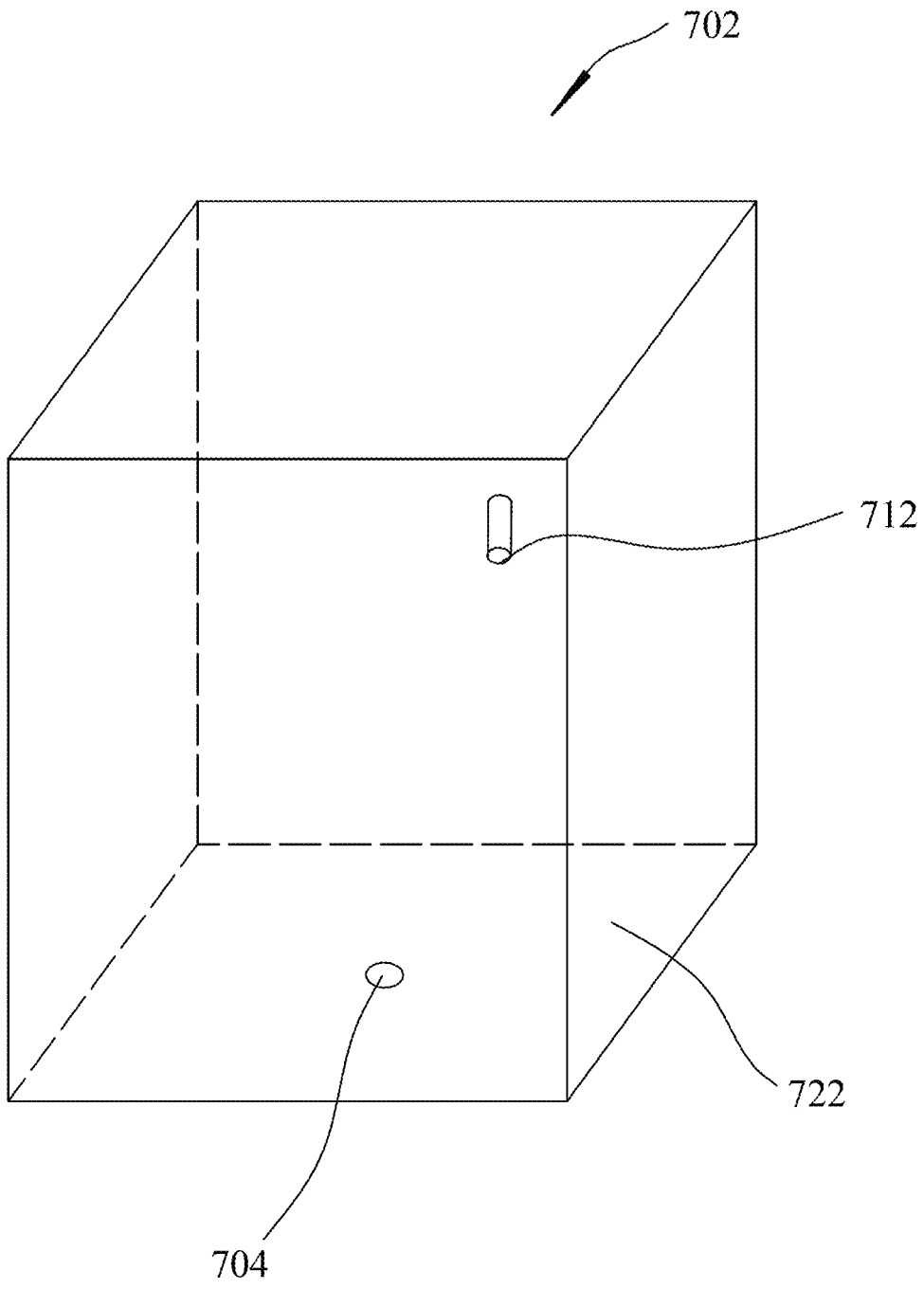
FIG. 7A is a schematic diagram of an application scenario of the first embodiment of the floor drain according to the present disclosure.

FIG. 7A is a schematic diagram of an application scenario of the first embodiment of the floor drain according to the present disclosure. The floor drain according to the present disclosure can be applied to a shower room 702. As shown in FIG. 7A, a faucet 712 is disposed in the shower room 702. Water can flow out of the faucet 712. A drainage hole 704 is formed in the floor 722 of the shower room 702. The faucet 712 is generally disposed above of one side of the shower room 702 (e.g., on a vertical wall). The drainage hole 704 is disposed approximately in the middle of the floor 722 of the shower room 702. In other words, the drainage hole 704 and the faucet 712 are offset from each other. That is to say, the water flowing out of the faucet 712 will not directly impinge on the drainage hole 704.

Figure 7B:
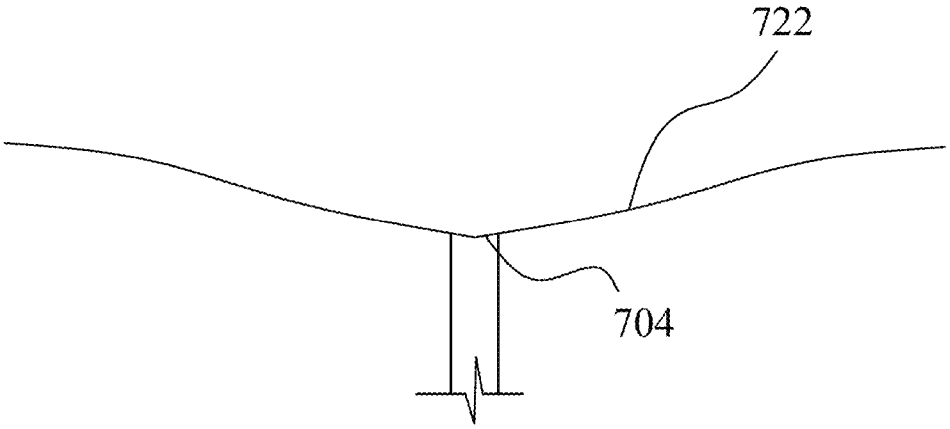
FIG. 7B is a sectional view of the floor and a drainage hole shown in FIG. 7A.

FIG. 7B is a sectional view of the floor 722 and the drainage hole 704 shown in FIG. 7A, which shows structures of the floor 722 and the drainage hole 704. As shown in FIG. 7B, the floor 722 is inclined toward the drainage hole 704, so that the water flowing out of the faucet 712 tends to flow toward the drainage hole 704. As an example, the drainage hole 704 is a through hole. That is to say, the drainage hole 704 is an inlet of a drainage pipe.

Figure 7C:
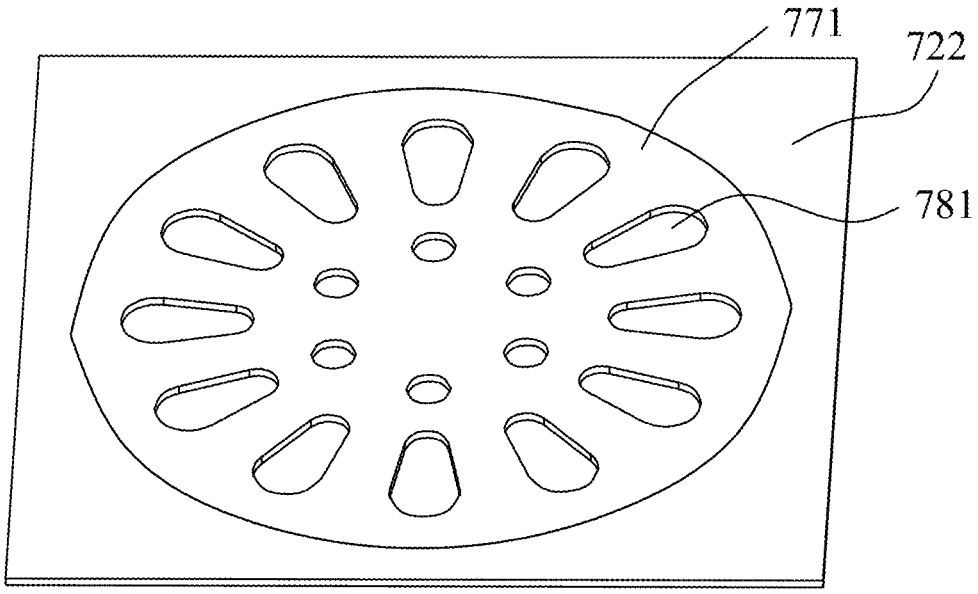
FIGS. 7C to 7E are perspective views of three types of cover plates respectively.
Figure 7D:
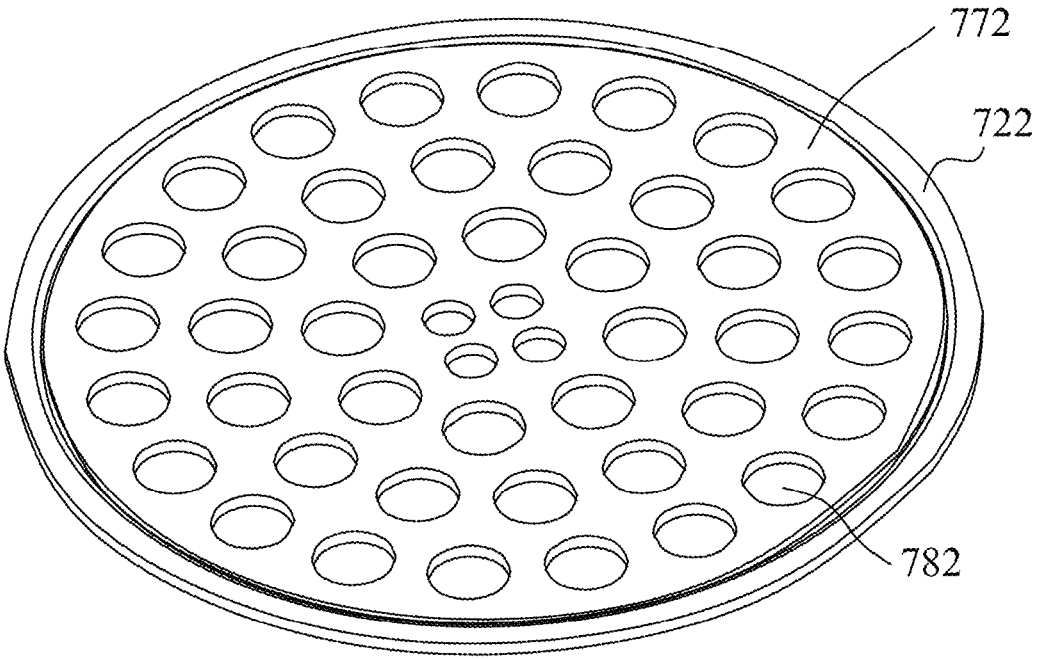
Figure 7E:
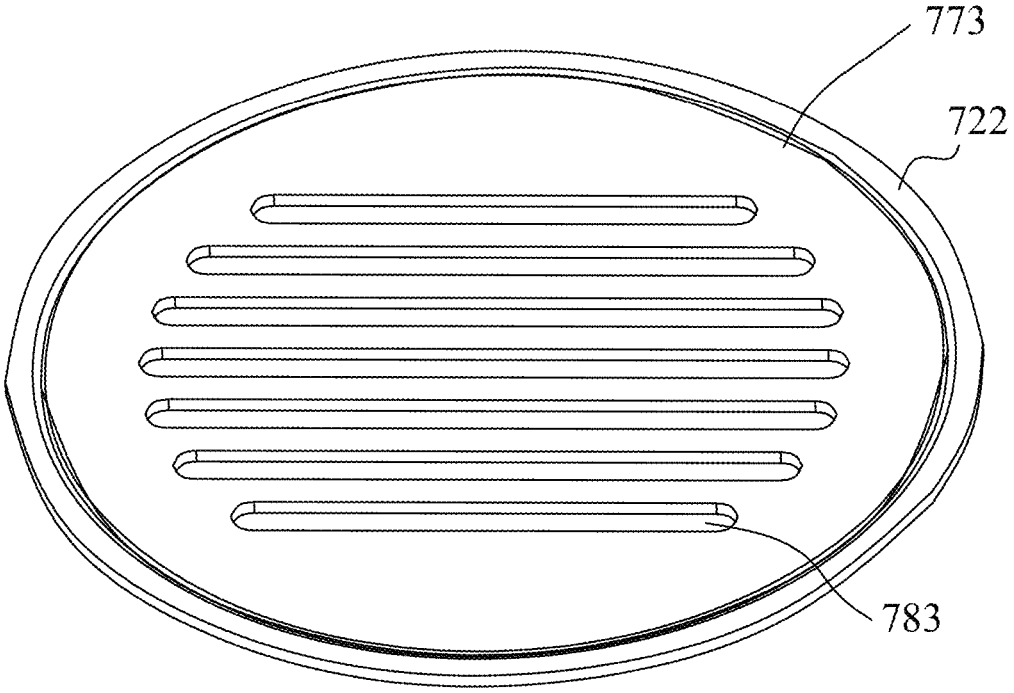

FIGS. 7C to 7E are perspective views of three types of cover plates respectively, where the cover plate can be covered on the drainage hole 704 shown in FIG. 7A. As shown in FIG. 7C, the first type of cover plate 771 is circular and covered on the drainage hole 704. The cover plate 771 is provided with a plurality of holes 781 with different sizes. The plurality of holes 781 are evenly arranged along the circumferential direction and substantially arranged into two circles along the radial direction. Holes on the outer circle are relatively large and substantially petal-shaped. Holes on the inner circle are relatively small and circular.

As shown in FIG. 7D, the second type of cover plate 772 is circular and covered on the drainage hole 704. The cover plate 772 is provided with a plurality of holes 782 with different sizes. The holes 782 are all circular holes. The plurality of holes 782 are evenly arranged along the circumferential direction and substantially arranged into four circles along the radial direction. The holes on the outer three circles are larger than those on the innermost circle.

As shown in FIG. 7E, the third type of cover plate 773 is circular and covered on the drainage hole 704. The cover plate 773 is provided with a plurality of holes 783 with different sizes. The plurality of holes 783 are all elongated, which are arranged substantially in parallel and evenly spaced.

As shown in FIGS. 7C to 7E, the cover plates covering the drainage holes 704 are generally plate-like. The holes formed in the cover plate allow water to flow into the drainage hole 704. It may be understood that a cover plate having any type of holes falls within the scope of protection of the present disclosure.

The floor drain according to the present disclosure has good adaptability, which can be covered on various types of cover plates, or directly covered on the drainage hole 704. When the floor drain covers on the cover plate or the drainage hole 704, the floor drain edge portion 102 can surround the cover plate or the drainage hole 704 and contact with the floor 722 around the drainage hole 704.

It should be noted that the drainage hole 704 in the present disclosure is not provided with or does not have a protrusion protruding from the floor 722. For example, no drainer (not shown) is provided on the drainage hole 704. The drainer described herein refers to a drainer including an openable part. The openable part has a closed state and an open state. For example, when the openable part is in the closed state, the openable part is substantially flush with the floor 722 and covers the drainage hole 704, thereby achieving a water storage function. When the openable part is in the open state, at least a part of the openable part protrudes away from the floor 722 (e.g., the openable part is rotatable or movable relative to the floor 722) to open the drainage hole 704, thereby achieving a drainage function.

Figure 7F:
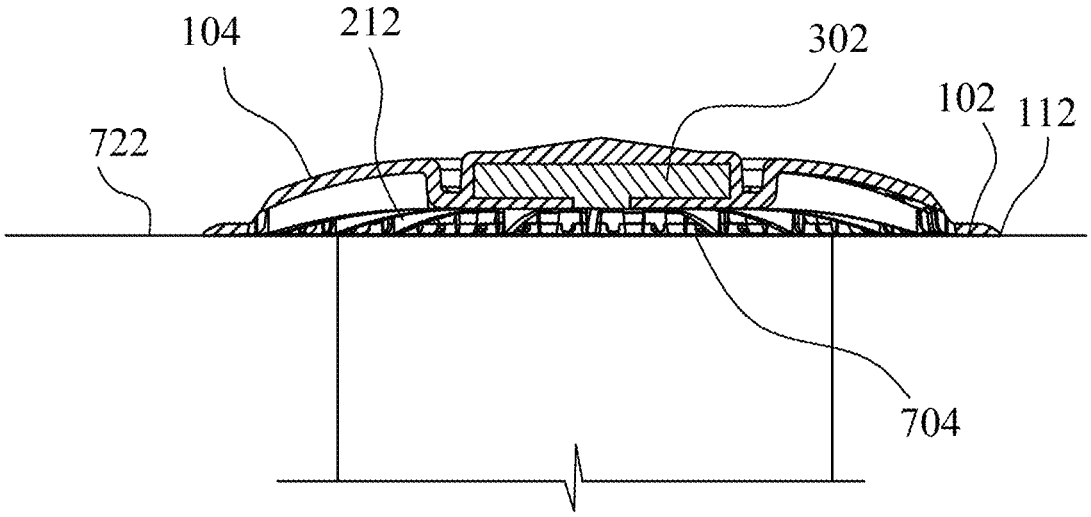
FIG. 7F is a sectional schematic diagram of the first embodiment of the floor drain according to the present disclosure when covering a drainage hole in a shower room.

FIG. 7F is a sectional schematic diagram of the first embodiment of the floor drain according to the present disclosure when covering on the drainage hole 704 of the shower room 702 shown in FIG. 7A, which shows the engaging relationship between the floor drain and the drainage hole 704.

As shown in FIG. 7F, when the floor drain covers on the drainage hole 704 of the shower room 702, the counterweight element 302 is approximately disposed in the middle of the drainage hole 704 of the shower room 702. The protrusion of the floor drain waist 104 of the floor drain is away from the floor drain edge portion 102 and the provision of the load-bearing reinforcement portion 204 enables the gravity of the counterweight element 302 to be well transferred to the floor drain edge portion 102, so that the floor drain edge portion 102 is stuck to the floor 722 around the drainage hole 704. That is to say, the radius A of the outer edge 112 of the floor drain edge portion 102 is greater than the radius of the drainage hole 704, so that the water leakage space 212 is disposed above the drainage hole 704. The water leakage space 212 will not block the drainage hole 704 or the holes in the cover plate, so that water may enter the drainage hole 704 through the water leakage space 212, so as to ensure the drainage speed. When the floor drain covers on the drainage hole 704 of the shower room 702, since the drainage hole 704 and the faucet 712 are offset from each other, the water flowing out of the faucet 712 will not directly impinge on the floor drain, but will form a layer of water on the floor 722. The water surface is submerged the floor drain edge portion 102, thereby applying a downward force to the floor drain edge portion 102 to keep the floor drain in place. In addition, since the floor drain edge portion 102 is made of a flexible material, when the water surface applies the force to the floor drain edge portion 102, a certain degree of deformation may occur on the floor drain edge portion 102, so that the air in the suction groove 402 (see FIG. 4) on the floor drain edge portion 102 is expelled out of the suction groove 402 while the lower surface of the floor drain edge portion 102 better sticks to the floor 722. A vacuum is formed in the suction groove 402 so that the lower surface of the floor drain edge portion 102 is struck to the floor 722 by suction. When the water flow is too large and the depth of the water is increased, the water can be drained through the water leakage holes 123 (e.g., the first waist through hole 124 and the second waist through hole 126) in the floor drain waist 104. In more detail, since the water leakage holes 123 (e.g., the first waist through hole 124 and the second waist through hole 126) pass through the floor drain waist 104 in the vertical direction, water can enter the water leakage space 212 through the water leakage holes 123 more quickly because of the gravity.

It should be noted that, although the present disclosure shows that the radius A of the outer edge 112 of the floor drain edge portion 102 is greater than the radius of the drainage hole 704 so that the floor drain edge portion 102 is stuck around the drainage hole 704, in other embodiments, the radius A of the outer edge 112 may be equal to the radius of the drainage hole 704 so that the floor drain edge portion 102 is stuck to the drainage hole 704.

In the prior art, existing floor drains include floor drains without counterweight and hat-type floor drains. The floor drain without counterweight is substantially in the shape of a paper sheet and is suitable for the drainage hole in the shower room. The hat-type floor drain is generally in the shape of a hat with a hollow portion, and is used in a basin or bathtub with a protrusion (e.g., a drainer). However, the inventors of the present disclosure discover that, on the one hand, the floor drain without counterweight fails to be applied to various types of cover plates, since no matter what kind of holes are formed in the floor drain without counterweight, the floor drain without counterweight will overlap at least some of the holes on the cover plate, thereby reducing the flow-through area of water and slowing down the drainage speed. On the other hand, the floor drain without counterweight fails to stick to the floor well and is easily flushed away by the water flow, which causes large displacement. The inventors of the present disclosure also find that although the hat-type floor drain has a hollow portion to receive the protrusion, it is not suitable for a shower room. On the one hand, the hat-type floor drain is easily flushed away by the water flow, resulting in a large displacement. On the other hand, since the hat-type floor drain is relatively high, a person in the shower room is likely to kick the hat-type floor drain.

TABLE 1

| | Gram weight | Size | Displacement generated when the water flow rate of the shower head is at 2-2.5 GPM | Drainage speed test after water storage: time required for complete drainage when the storage capacity is 1.9 liters |
|---|---|---|---|---|
| Existing floor drain without counterweight | 43 g | 5.51 * 5.51 * 0.3937 inches (14 * 14 * 1 cm) | Above 1.1811 inches (3 cm) to 1.9685 inches (5 cm) | 12 seconds 34 |
| Existing hat-type floor drain | 90 g-counter-weight | 4.33 * 4.33 * 1.8898 inches (11 * 11 * 4.8 cm) | Above 0.7874 inches (2 cm) to 1.1811 inches (3 cm) | 12 seconds 25 |
| Floor drain of the present disclosure | 90 g-counter-weight | 5.51 * 5.51 * 0.669 inches (14 * 14 * 1.7 cm) | Within 0.3937 inches (1 cm) to 0.7874 inches (2 cm) | 9 seconds 27 |

Table 1 shows experimental comparison results of the floor drain according to the present disclosure relative to the floor drain without counterweight and the hat-type floor drain. The water flow rate of existing shower heads is generally 2-2.5 GPM (i.e., gallons per minute). At this speed, both the floor drain without counterweight and the hat-type floor drain produce a large displacement, whereas the floor drain according to the present disclosure can remain in place relative to the drainage hole 704. The maximum possible water storage capacity of an existing shower room is 1.9 liters. When draining water under this water storage capacity, both the floor drain without counterweight and the hat-type floor drain require a long time, whereas the floor drain according to the present disclosure reduces the time by nearly 3 seconds compared with the existing floor drains.

Figure 8A:
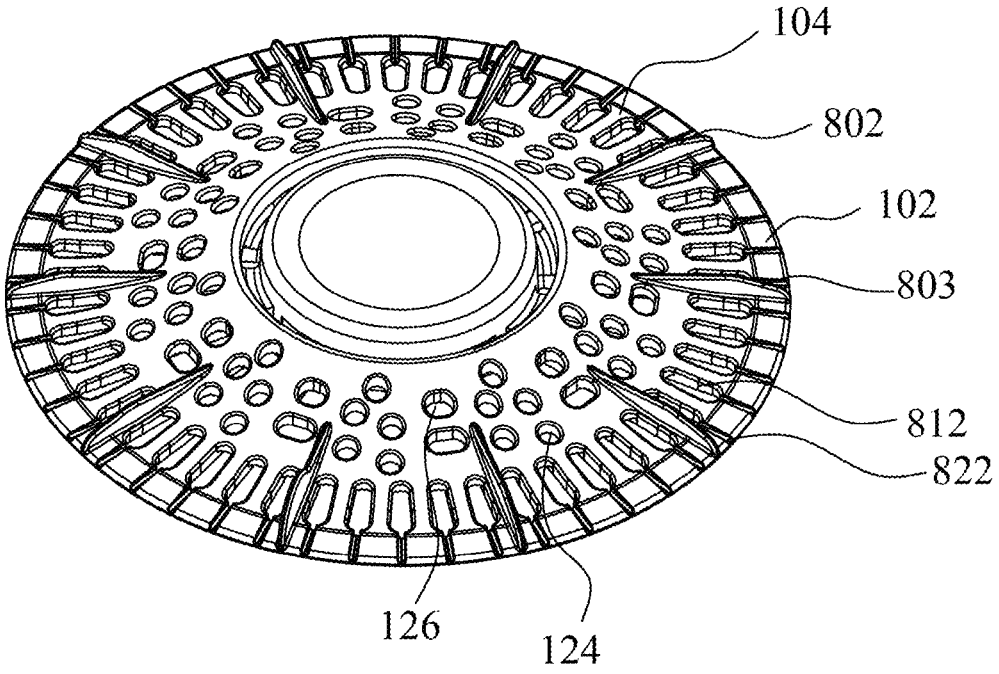
FIG. 8A is a perspective view of a second embodiment of the floor drain according to the present disclosure when viewed from top to bottom.
Figure 8B:
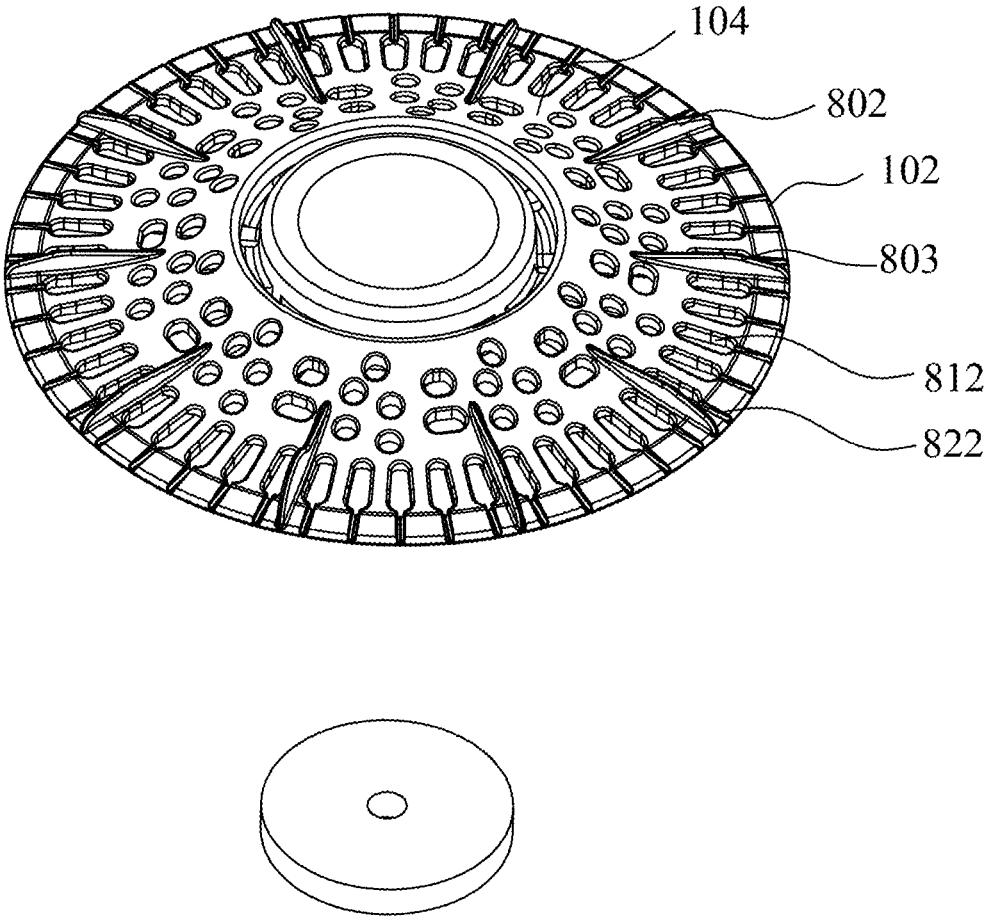
FIG. 8B is an exploded view of the second embodiment of the floor drain according to the present disclosure as shown in FIG. 8A.
Figure 8C:
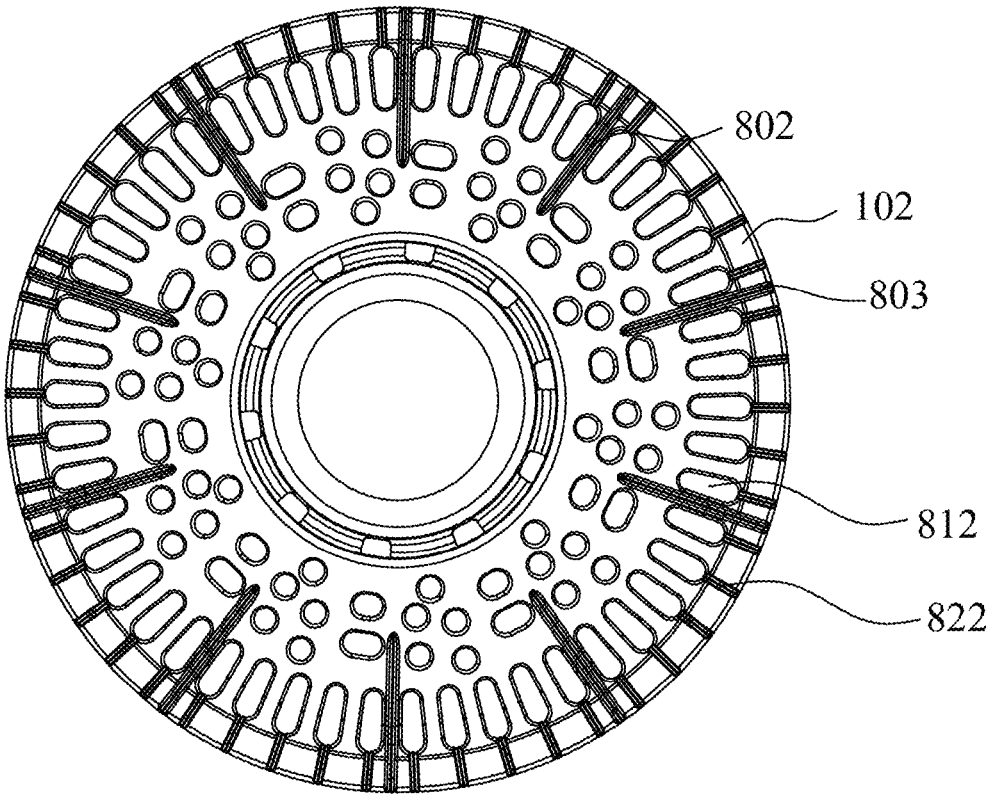
FIG. 8C is a top view of the second embodiment of the floor drain according to the present disclosure as shown in FIG. 8A.
Figure 8D:
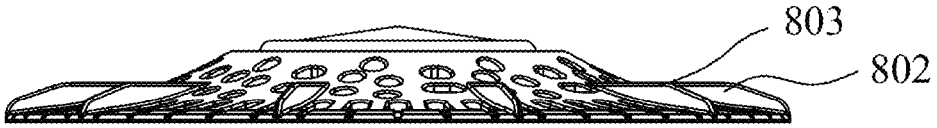
FIG. 8D is a front view of the second embodiment of the floor drain according to the present disclosure as shown in FIG. 8A.
Figure 8E:
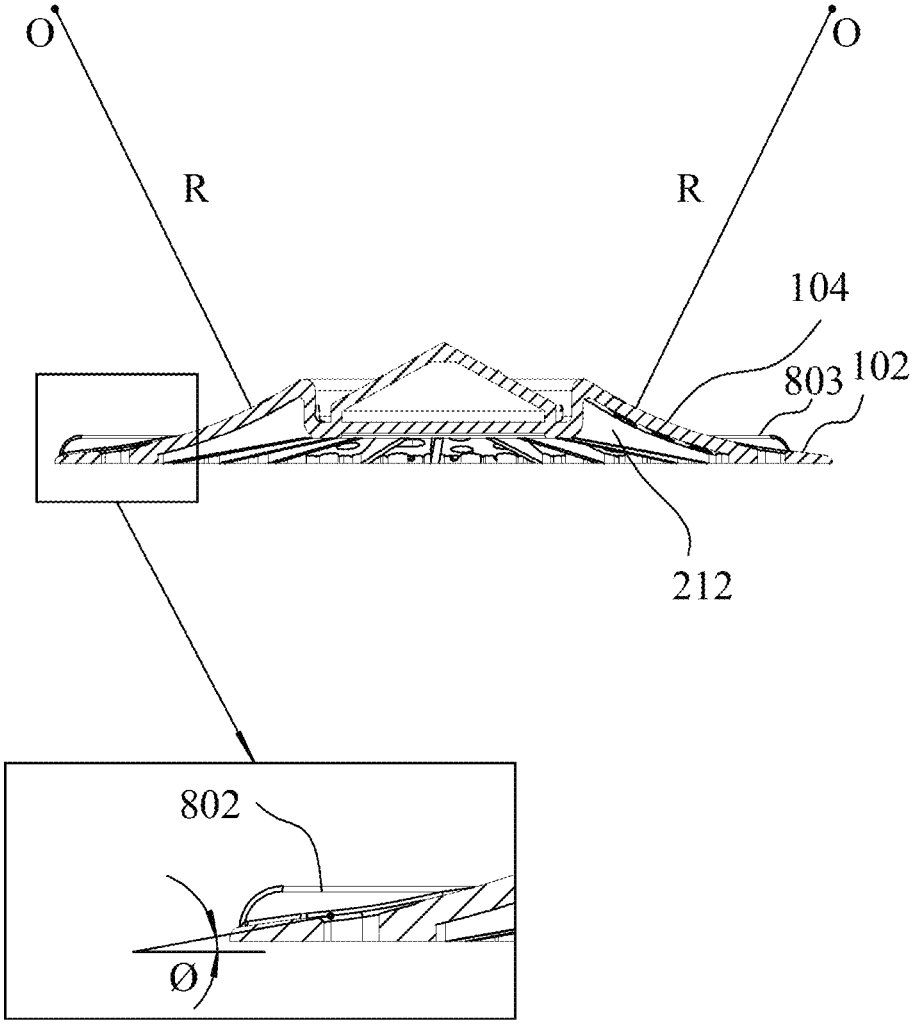
FIG. 8E is a sectional view of the second embodiment of the floor drain according to the present disclosure as shown in FIG. 8A.

FIGS. 8A to 8E show a second embodiment of the floor drain according to the present disclosure. FIG. 8A is a perspective view of a second embodiment of the floor drain according to the present disclosure when viewed from top to bottom. FIG. 8B is an exploded view of the second embodiment of the floor drain according to the present disclosure as shown in FIG. 8A. FIG. 8C is a top view of the second embodiment of the floor drain according to the present disclosure as shown in FIG. 8A. FIG. 8D is a front view of the second embodiment of the floor drain according to the present disclosure as shown in FIG. 8A. FIG. 8E is a sectional view of the second embodiment of the floor drain according to the present disclosure as shown in FIG. 8A. The similarities between the second embodiment shown in FIGS. 8A to 8E and the first embodiment shown in FIGS. 1A to 6 will not be repeated here. The differences between the second embodiment shown in FIGS. 8A to 8E and the first embodiment shown in FIGS. 1A to 6 are mainly as follows. First, the floor drain waist 104 of the floor drain shown in FIGS. 1A to 6 is protruded away from the floor drain edge portion 102, whereas the floor drain waist 104 of the floor drain shown in FIGS. 8A to 8E is protruded toward the floor drain edge portion 102. Second, the floor drain shown in FIGS. 8A to 8E further includes a blocking portion. Third, the water leakage holes 123 of the floor drain shown in FIGS. 8A to 8E further include a plurality of third waist through holes 812.

Specifically, as shown in FIG. 8E, the floor drain waist 104 is formed by extending inward from the circular inner edge 114 of the floor drain edge portion 102 and in the shape of a dome, and the floor drain waist 104 forms an upward narrowed water leakage space 212 in the shape of a dome. A height H of the water leakage space 212 is in a value range of: 0.0787 inches (2 mm)≤H≤0.35433 inches (9 mm). The cross-section of the floor drain waist 104 is an arc, which has a center O. The center O is above the floor drain, so that the floor drain waist 104 is protruded toward the floor drain edge portion 102. A radius R of the arc is in a value range of: 2.3622 inches (60 mm)≤R≤3.5433 inches (90 mm). An angle φ between the floor drain waist 104 and the horizontal plane is in a value range of: 12°≤φ≤20°. More specifically, the angle φ between each point on the floor drain waist 104 and the horizontal plane (i.e., the lower surface of the floor drain edge portion 102) is in the value range of: 12°≤φ≤20°.

In addition, as shown in FIGS. 8A to 8E, the floor drain further includes a blocking portion 802 for blocking foreign objects (e.g., hair). The blocking portion 802 is disposed on the floor drain edge portion 102 and the floor drain waist 104 and above the floor drain edge portion 102 and the floor drain waist 104. More specifically, the blocking portion 802 includes a plurality of blocking ribs 803. The plurality of blocking ribs 803 are evenly arranged along the circumferential direction of the floor drain. The blocking rib 803 is formed by extending along the radial direction of the floor drain, thereby connecting the floor drain edge portion 102 and the floor drain waist 104. Thus, the blocking portion 802 can not only block foreign objects but also improve the connection strength between the floor drain waist 104 and the floor drain edge portion 102, thereby contributing to the maintenance of the water leakage space 212 (see FIG. 8E).

In addition, as shown in FIGS. 8A to 8C, a plurality of third waist through holes 812 are further formed in the floor drain waist 104 of the floor drain. The plurality of third waist through holes 812 are disposed outside the plurality of first waist through holes 124 and the plurality of second waist through holes 126, and are evenly arranged along the circumferential direction of the floor drain. The third waist through hole 812 passes through the floor drain waist 104 along the vertical direction. In other words, the extension direction of the third waist through hole 812 is approximately 90° to the lower surface of the floor drain edge portion 102. The floor drain edge portion 102 of the second embodiment shown in FIGS. 8A to 8E is not provided with a plurality of edge portion through holes 304, but is provided with a plurality of edge portion grooves 822. Specifically, the plurality of edge portion grooves 822 are provided on the floor drain edge portion 102. The edge portion groove 822 is formed by recessing downward from upper surface of the floor drain edge portion 102 and extending in the radial direction. The plurality of edge portion grooves 822 are disposed corresponding to the plurality of third waist through holes 812. That is, the edge portion groove 822 is in communication with the third waist through hole 812, so that water in the edge portion groove 822 can enter the water leakage space 212 through the third waist through hole 812.

It should be noted that, although the blocking portion 802 is not provided in the first embodiment of the floor drain according to the present disclosure, those skilled in the art may understand that the blocking portion 802 may also be disposed on the floor drain waist 104 of the first embodiment of the floor drain according to the present disclosure.

Figure 9:
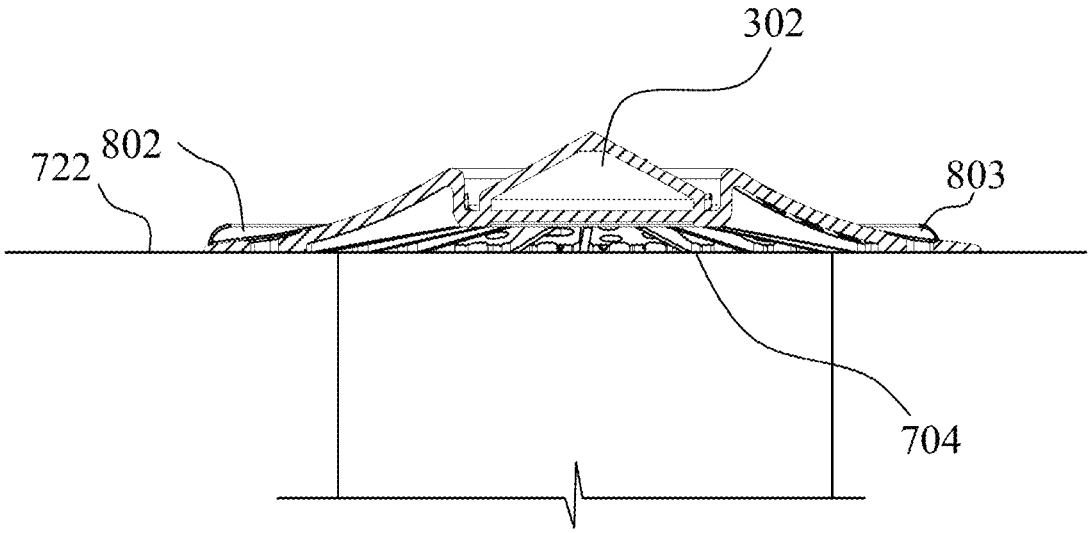
FIG. 9 is a sectional schematic diagram of the second embodiment of the floor drain according to the present disclosure when covering a drainage hole in a shower room.

FIG. 9 is a sectional schematic diagram of the second embodiment of the floor drain according to the present disclosure when covering on the drainage hole 704 of the shower room 702 shown in FIG. 7A, which shows the engaging relationship between the floor drain and the drainage hole 704.

As shown in FIG. 9, when the floor drain covers on the drainage hole 704 of the shower room 702, the counterweight element 302 is approximately disposed in the middle of the drainage hole 704 of the shower room 702. The counterweight element 302 applies gravity to the floor drain edge portion 102, so that the floor drain edge portion 102 is stuck around the drainage hole 704. That is to say, the radius A of the outer edge 112 of the floor drain edge portion 102 is greater than the radius of the drainage hole 704, so that the water leakage space 212 is disposed above the drainage hole 704. When the floor drain covers on the drainage hole 704 of the shower room 702, since the drainage hole 704 and the faucet 712 are offset from each other, the water flowing out of the faucet 712 will not directly impinged on the floor drain, but will form a layer of water on the floor 722. The water surface is submerged the floor drain edge portion 102, thereby applying a downward force to the floor drain edge portion 102 to keep the floor drain in place. Water flows toward the third waist through hole 812 through the edge portion groove 822, and enters the water leakage space 212 through the third waist through hole 812.

It should be noted that, although the cross-section of the floor drain waist 104 of the floor drain according to the present disclosure is in the shape of an arc, in other embodiments, the cross-section of the floor drain waist 104 may be a plurality of smoothly connected arcs or a plurality of smoothly connected curves, so that the floor drain waist 104 is configured to extend inward and obliquely upward to form the upward narrowed water leakage space.

According to the present disclosure, it may be understood that because the floor drain waist 104 narrows upward and is substantially flared, the circular counterweight element 302 can be properly installed on the top of the floor drain. In addition, the weight of the counterweight element 302, the height of the water leakage space 212, the selection of the angle of inclination of the floor drain waist 104 and the provision of the load-bearing reinforcement portion 204 on the floor drain 100 enable the floor drain 100 made of a flexible material to stably cover the drainage hole 704, so that the floor drain edge portion 102 is stably struck to the periphery of the drainage hole 704 by suction, and the floor drain 100 made of a flexible material does not deform or produces slight deformation. In this way, although there is no water leakage hole on the top of the counterweight element 302, water can still smoothly flow into the water leakage space 212 through the holes of the floor drain waist 104 smoothly and then flow into the drainage hole 704.

It should be noted that the designed structure in the present disclosure generally has a small height and sufficient drainage holes and drainage space. When the specific parameters of the designed structure in the present disclosure are selected, the factors to be considered include:

(1) The floor drain 100 needs a good drainage performance, but the inventors of the present disclosure have observed that there are limitations on the height of the floor drain 100 in some usage scenarios. For example, it is required that the floor drain 100 is not easily flushed away by flowing water, and at the same time, it is required that the floor drain 100 is prevented from being easily kicked and moved by the person who is bathing. Therefore, due to the height limitation of the floor drain 100, the present disclosure needs to consider reasonably arranging the structure and area of the floor drain 100 for drainage under the condition of the height limitation, so as to maintain an optimized floor drain drainage space and drainage channel.

(2) Since the counterweight element 302 made of a metal material is disposed on the top of the floor drain 100 and there is no drainage hole on the counterweight element 302, the present disclosure needs to consider under the limitation that there is no drainage hole on the top of the floor drain 100, it is needed to reasonably arrange the drainage structure and area of the floor drain 100, so as to maintain an optimized floor drain drainage space and drainage channel.

(3) Since the floor drain 100 is made of a flexible material (including at least one of silicone, rubber, thermoplastic elastomer (TPE) or thermoplastic rubber (TPR) or thermoplastic vulcanizate (TPV)) and the thickness of the housing of the floor drain 100 is limited, the gravity of the counterweight element 302 will cause the floor drain 100 to tend to deform. The present disclosure considers the reasonable arrangement of the structure of the floor drain 100 under the condition of the flexible material and the counterweight element 302 disposed on the top thereof, so as to maintain an optimized floor drain drainage space and drainage channel.

(4) In order to have a certain resistance to the impact of the water flow, the counterweight element 302 is disposed on the top of the floor drain 100, so that the floor drain 100 can be firmly stuck to the supporting surface. However, an overly heavy counterweight element 302 will cause the floor drain 100 to deform. Therefore, when selecting the weight of the counterweight element 302, it is required to take into account the impact on other structures of the floor drain 100, thus the present disclosure is required to consider optimizing the weight of the counterweight, so as to maintain an optimized floor drain drainage space and drainage channel.

(5) In order to reduce the impact of water flow on the floor drain and increase the area of a water flow hole, the present disclosure is required to appropriately select the structure of the floor drain waist 104. For example, the radius R of the arc of the floor drain waist 104 is selected.

(6) In order to resist the impact of the water flow, the present disclosure is required to appropriately design the shape of the outer edge of the floor drain. For example, the angle φ between each point on the floor drain waist 104 and the horizontal plane is selected.

In view of the above considerations, the present disclosure selects several parameters of the floor drain 100 (including the floor drain material, the total height of the floor drain, the weight of the counterweight element, the thickness of the floor drain waist, the height of the counterweight element, the angle between the floor drain waist and the horizontal plane, the radius of the arc of the floor drain waist 104, and the radius of the inner edge of the floor drain edge portion). The ranges of these parameters are as follows:

The floor drain edge portion 102, the floor drain waist 104 and the load-bearing portion 106 of the floor drain 100 according to the present disclosure are made of a flexible material. The flexible material includes at least one of silicone, rubber, TPE, TPR or TPV.

The counterweight element 302 may be made of metal or an alloy. The alloy includes at least two of stainless steel, iron, and lead.

The total height K of the floor drain is in a value range of: 0.59055 inches (15 mm)≤K≤0.787 inches (20 mm).

The weight G of the counterweight element 302 is in a value range of: 50 g<G<100 g.

The thickness T of the floor drain waist 104 is in a value range of: 0.0906 inches (2.3 mm)≤T≤0.102 inches (2.6 mm).

The height h of the counterweight element 302 is in a value range of: 0.197 inches (5 mm)≤h≤0.276 inches (7 mm).

The angle φ between the floor drain waist 104 and the horizontal plane is in a value range of: 12°≤φ≤20°.

The radius R of the arc of the floor drain waist 104 is in a value range of: 2.3622 inches (60 mm)≤R≤3.5433 inches (90 mm).

The radius B of the inner edge of the floor drain edge portion 102 is in a value range of: 1.88976 inches (48 mm)≤B≤3.34646 inches (85 mm).

Several parameters of the floor drain 100 in the present disclosure are as follows.

The total height K of the floor drain is 0.669 inches (17 mm).

The weight G of the counterweight element 302 is 90 g.

The thickness T of the floor drain waist 104 is 0.09449 inches (2.4 mm).

The height h of the counterweight element 302 is 0.23622 inches (6 mm).

The angle φ between the floor drain waist 104 and the horizontal plane is 20°.

The radius R of the arc of the floor drain waist 104 is 3.1496 inches (80 mm).

The radius B of the inner edge of the floor drain edge portion 102 is 2.48 inches (63 mm).

The radius A of the outer edge 112 of the floor drain edge portion 102 is 2.7559 inches (70 mm).

Although the present disclosure is described with reference to the examples of embodiments outlined above, various alternatives, modifications, variations, improvements and/or substantial equivalents, which are known or anticipated at present or to be anticipated before long, may be obvious to those of at least ordinary skill in the art. In addition, the technical effects and/or technical problems described in this specification are exemplary rather than limiting; Therefore, the disclosure in this specification may be used to solve other technical problems and have other technical effects and/or may solve other technical problems.

Accordingly, the examples of the embodiments of the present disclosure as set forth above are intended to be illustrative rather than limiting. Various changes may be made without departing from the spirit or scope of the present disclosure. Therefore, the present disclosure is intended to embrace all known or earlier disclosed alternatives, modifications, variations, improvements and/or substantial equivalents.

The invention claimed is:

1. A floor drain, comprising:

a floor drain edge portion having an outer edge and a circular inner edge;

a floor drain waist extending inward and upward from the circular inner edge, a distal end of the floor drain waist forming a waist edge;

a load-bearing portion connected to the waist edge; and a counterweight element disposed on the load-bearing portion, wherein the floor drain waist extends upward to form a water leakage space, the water leakage space being below the counterweight element, and water leakage holes are formed in the floor drain waist, and the water leakage holes are configured to allow water to enter the water leakage space through the water leakage holes.

2. The floor drain of claim 1, wherein the floor drain waist is formed by extending inward from the circular inner edge and obliquely upward, and the floor drain waist extends obliquely upward to form the upward narrowed water leakage space.

3. The floor drain of claim 2, wherein the floor drain waist is formed by extending inward from the circular inner edge and in the shape of a dome, and the floor drain waist forms the upward narrowed water leakage space in the shape of a dome.

4. The floor drain of claim 3, wherein a cross section of the floor drain waist is an arc, and a radius R of the arc is in a value range of:

$$2.3622 \text{ inches (60 mm)} \leq R \leq 3.5433 \text{ inches (90 mm)}.$$

5. The floor drain of claim 4, wherein a center of the arc is below the floor drain, such that the floor drain waist is protruded away from the floor drain edge portion.

6. The floor drain of claim 4, wherein a center of the arc is above the floor drain, such that the floor drain waist is protruded toward the floor drain edge portion.

7. The floor drain of claim 1, wherein a cross-section of the load-bearing portion and a cross-section of the counterweight element are circular.

8. The floor drain of claim 1, wherein an angle φ between the floor drain waist and a horizontal plane is in a value range of:

$$12° \leq \varphi \leq 20°.$$

9. The floor drain of claim 1, wherein a height H of the water leakage space is in a value range of:

$$0.07874 \text{ inches (2 mm)} \leq H \leq 0.35433 \text{ inches (9 mm)}.$$

10. The floor drain of claim 1, further comprising:

a load-bearing reinforcement portion, which is disposed on the floor drain waist and the floor drain edge portion and below the floor drain waist.

11. The floor drain of claim 10, wherein the load-bearing reinforcement portion comprises at least two reinforcement ribs, and the reinforcement ribs are formed by extending in a radial direction of the floor drain.

12. The floor drain of claim 1, wherein the water leakage holes comprise at least one first waist through hole passing through the floor drain waist in a vertical direction.

13. The floor drain of claim 12, wherein the water leakage holes further comprise at least one second waist through hole passing through the floor drain waist in the vertical direction, wherein a cross-sectional area of the first waist through hole is different from that of the second waist through hole.

14. The floor drain of claim 1, wherein a groove is disposed on the floor drain waist, and the groove is formed by recessing downward from an upper surface of the floor drain waist and surrounding the load-bearing portion.

15. The floor drain of claim 14, wherein at least one groove through hole is formed in the floor drain waist, and the groove through hole extends downward from a bottom of the groove and passes through the floor drain waist.

16. The floor drain of claim 1, further comprising:

a blocking portion, which is disposed on the floor drain edge portion and the floor drain waist and above the floor drain edge portion and the floor drain waist.

17. The floor drain of claim 16, wherein the blocking portion comprises at least two blocking ribs formed by extending in a radial direction of the floor drain.

18. The floor drain of claim 1, wherein the floor drain edge portion, the floor drain waist and the load-bearing portion are formed by means of integral molding.

19. The floor drain of claim 1, wherein the floor drain edge portion, the floor drain waist and the load-bearing portion are made of a flexible material, which includes at least one of silicone, rubber, TPE, TPR or TPV;

the counterweight element is made of metal or alloy; and the alloy includes at least two of stainless steel, iron, and lead.

20. The floor drain of claim 1, wherein the floor drain is configured to cover a drainage hole of a shower room; and the counterweight element is substantially located in the middle of the drainage hole of the shower room.

21. The floor drain of claim 20, wherein the drainage hole is substantially located in the middle of a floor of the shower room, and the floor of the shower room is inclined toward the drainage hole.

22. The floor drain of claim 20, wherein a density of the counterweight element is greater than that of each of the floor drain edge portion, the floor drain waist and the load-bearing portion, such that the counterweight element applies gravity to the floor drain edge portion such that the floor drain edge portion is stuck to or around the drainage hole.

23. The floor drain of claim 20, wherein a faucet is installed above one side of the shower room, and the faucet and the drainage hole are offset from each other.

24. The floor drain of claim 1, wherein a weight G of the counterweight element is in a value range of:

$50\ g<G<100\ g$.

25. The floor drain of claim 1, wherein a radius A of the outer edge of the floor drain edge portion is in a value range:

2.165 inches (55 mm)$<A<$3.937 inches (100 mm).

26. The floor drain of claim 1, wherein a radius B of the inner edge of the floor drain edge portion is in a value range of:

1.88976 inches (48 mm)$\leq B\leq$3.34646 inches (85 mm).

27. The floor drain of claim 1, wherein a total height K of the floor drain is in a value range of:

0.59055 inches (15 mm)$\leq K\leq$0.7874 inches (20 mm).

28. The floor drain of claim 1, wherein a height h of the counterweight element is in a value range of:

0.1969 inches (5 mm)$\leq h\leq$0.27559 inches (7 mm).

29. The floor drain of claim 1, wherein a thickness T of the floor drain waist is in a value range of:

0.09055 inches (2.3 mm)$\leq T\leq$0.10236 inches (2.6 mm).

30. The floor drain of claim 1, wherein a total height K of the floor drain is 0.669 inches (17 mm), and a weight G of the counterweight element is 90 g; a thickness T of the floor drain waist is 0.9449 inches (2.4 mm); a height h of the counterweight element is 0.23622 inches (6 mm); an angle q between the floor drain waist and a horizontal plane is 20°; a radius R of an arc of the floor drain waist is 3.1496 inches (80 mm); a radius B of the inner edge of the floor drain edge portion is 2.48 inches (63 mm); and a radius A of the outer edge of the floor drain edge portion is 2.7559 inches (70 mm).

* * * * *